US005799603A

United States Patent [19]

Tellington

[11] Patent Number: 5,799,603

[45] Date of Patent: Sep. 1, 1998

[54] SHOCK-ABSORBING SYSTEM FOR FLOATING PLATFORM

[76] Inventor: Wentworth J. Tellington, P.O. Box 68291, Tucson, Ariz. 85737

[21] Appl. No.: 771,486

[22] Filed: Dec. 23, 1996

Related U.S. Application Data

[63] Continuation-in-part of Ser. No. 404,049, Mar. 14, 1995, Pat. No. 5,588,387, which is a continuation-in-part of Ser. No. 154,119, Nov. 18, 1993, Pat. No. 5,398,635.

[51] Int. Cl.[6] ..... B63B 35/50

[52] U.S. Cl. ..... 114/261; 114/264

[58] Field of Search ..... 114/56, 57, 61, 114/261, 121, 123, 266, 265, 292, 264, 283; 440/9, 10

[56] References Cited

U.S. PATENT DOCUMENTS 2,347,959 5/1944 Moore et al. ..... 114/61

3,541,987 11/1970 Barkley ..... 114/61

*Primary Examiner*—Stephen Avila

*Attorney, Agent, or Firm*—Antonio R. Durando

[57] ABSTRACT

A modular floating platform that includes new features to improve its stability and performance. One feature is a novel universal joint between the buoyant hull assembly and the deck of each module in the floating platform. Another novel aspect concerns a walking beam of A-frame configuration for supporting pair of buoyant hulls in each assembly. Each hull is pivotally attached to the A-frame at a point below the center of gravity of the hull, so that the point of application of the upward force resulting from its buoyancy is always above its axis of rotation. A hydraulic system provides vertical shock absorption and balance to each hull assembly. In addition, fluid flow through the hydraulic system provides a means for generating usable energy.

20 Claims, 4 Drawing Sheets

SHOCK-ABSORBING SYSTEM FOR FLOATING PLATFORM

RELATED APPLICATIONS

This is a continuation-in-part application of U.S. Ser. No. 08/404,049, filed on Mar. 14, 1995, noticed for issuance on Dec. 31, 1996, as U.S. Pat. No. 5,588,387, which is based on a continuation-in-part application of U.S. Ser. No. 08/154,119, filed by the same inventor on Nov. 18, 1993, and issued as U.S. Pat. No. 5,398,635.

BACKGROUND OF THE INVENTION

1. Field of the Invention

The invention pertains to the general field of floating structures and, in particular, to a shock-absorbing load and buoyant support mechanism for floating platforms, particularly those of modular construction.

2. Description of the Prior Art

The prior art describes many floating structures utilized for various purposes. Over the years, the applications for such structures have been limited by the size considered safe under rough weather conditions because of the difficulty in maintaining the integrity and stability of a large floating structure in high winds and waves.

In U.S. Pat. Nos. 5,398,635 and 5,588,387, hereby incorporated by reference, I describe a concept and some refinements for a floating airport and other floating structures capable of accommodating a large number of aircraft, buildings, and other operational facilities. Floating structures built according to my design tend to be modular and very large; thus, their substantially rigid construction also results in severe stresses on the structure under high wind and wave conditions. Therefore, the relative lack of flexibility of large floating structures must be accounted for in designing construction specifications that guarantee the integrity of the structure and the safety of its occupants under all weather conditions. These requirements continue to challenge the inventiveness of design engineers in the art.

During the course of further refining the floating structures disclosed in the referenced patents, I have developed a method and details of construction for a buoyant load-bearing assembly particularly adapted for improving the overall stability and physical integrity of these structures under harsh ocean conditions. The idea is to absorb as much as possible of the energy of the waves striking the floating structure before their force is transmitted to the rigid platform or deck supporting the operational facilities. In the ideal case, all wave energy would be attenuated below deck with apparatus capable of absorbing horizontal as well as vertical forces exerted on the buoyant hulls of the structure. The solution to this problem would allow the assembly and safe operation of larger and more rigid floating structures. This disclosure is directed at the details of such shock-absorbing apparatus.

BRIEF SUMMARY OF THE INVENTION

An objective of this invention is to provide a flexible and shock-absorbing connection between the main body of a floating structure and the buoyant hulls that support it over water.

Another objective of the invention is a load-bearing mechanism capable of absorbing lateral as well as vertical forces resulting from the waves in the body of water supporting the floating structure.

Another goal of the invention is a mechanism capable of absorbing most of the energy carried by waves striking the buoyant hulls that support the floating structure.

Still another goal is apparatus that adjusts to the height of a wavefront passing through the floating structure.

Another objective is an arrangement that is suitable for use with any buoyant-hull construction design.

Finally, an objective of the invention is a shock-absorbing, load-bearing mechanism and method of connection that is suitable for assembling and operating floating structures in general, irrespective of intended use.

Therefore, in accordance with these and other objectives, one aspect of the invention consists of a novel universal joint used to connect the buoyant hull assemblies of a floating platform to the deck. The joint consists of a rigid block housing a transverse shaft with one end anchored to the block in swivel arrangement and supported along its length in a curved oblong opening with a bottom or top vertex, such that the shaft rests in stable equilibrium at the vertex of the curve in the opening when free from lateral forces. If such forces are exerted on the shaft, it can swing laterally within the opening and rotate within the anchor point. By utilizing two such universal joints disposed at a right angle from one another, the hull assembly is given a measured degree of freedom for movement in all directions to account for the various motions of the floating platform.

Another aspect of the invention concerns an A-frame configuration of the walking beam supporting the buoyant hulls of the floating platform. The bottom portion of each hull is pivotally attached to an A-frame below the universal joint, such that the line of action of the buoyant force of the assembly is located above the pivot axis of the hull. This configuration provides stability to the system while allowing the hulls to adjust their position to the changing profile of the water surface in which they float. Still relating to the hulls of the invention, another novel aspect is the combination of a mostly submerged, lower portion of the hull, that provides the required buoyancy, with an upper empty portion fitted with drainage holes and scuppers to trap water and absorb the energy of waves splashing over it.

According to yet another aspect of the invention, the deck of the floating platform is connected to the supporting hull assemblies above the universal joint through a hydraulic system that provides vertical shock absorption and balance to the various hull assemblies. In addition, it can provide energy generation. Each hull assembly includes a hydraulic cylinder with a resilient ram urging it downward; the hydraulic side of each cylinder is in fluid communication with the ram of another hull assembly, such that the compression of one cylinder is accompanied by the expansion of the other to adjust to corresponding differences in the height of a wavefront.

Various other purposes and advantages of the invention will become clear from its description in the specification that follows, and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

DETAILED DESCRIPTION OF THE INVENTION

Figure 1:
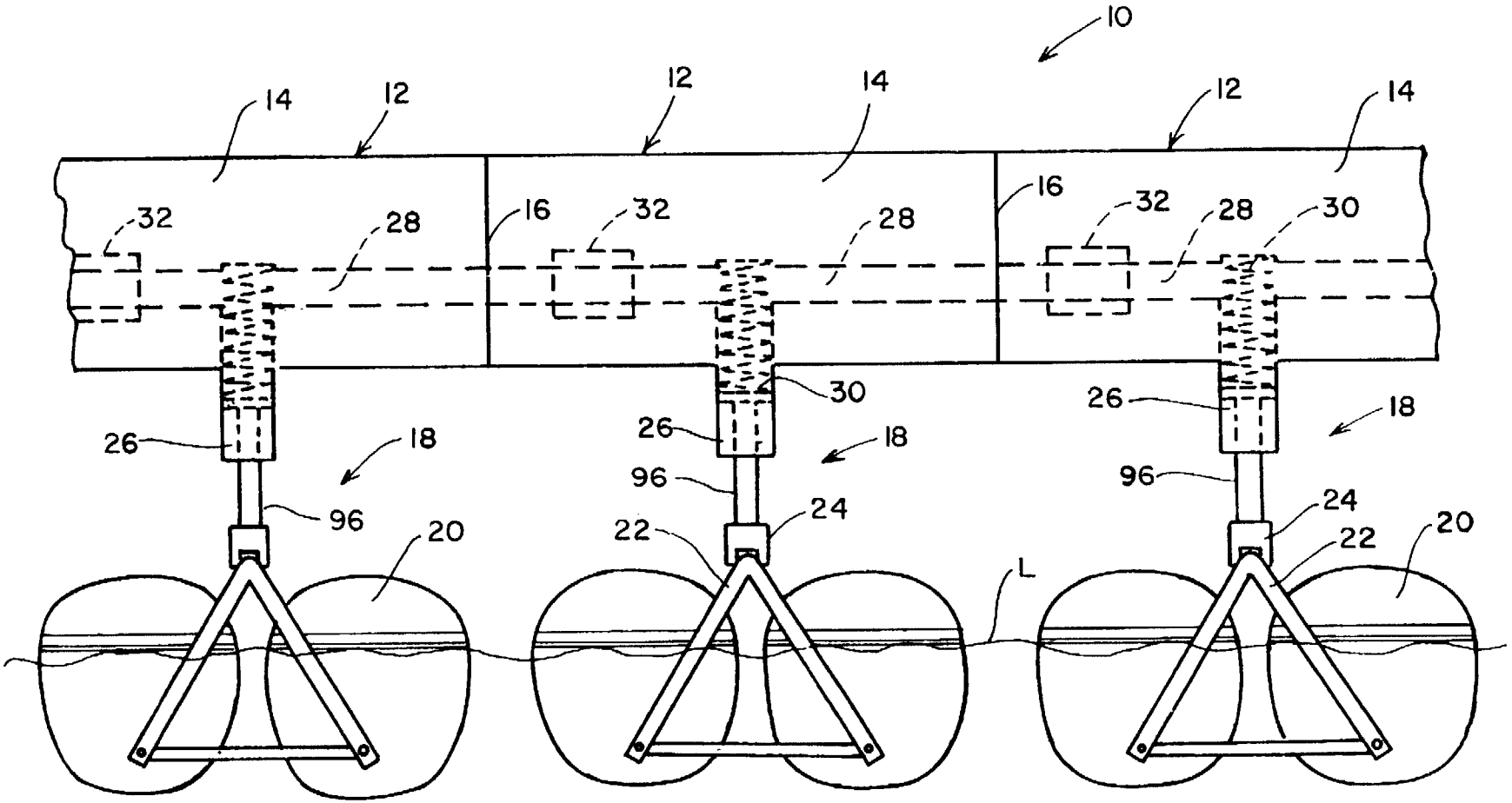
FIG. 1 illustrates in schematic elevational view the general configuration of a floating structure consisting of modular upper decks supported by partially-submerged modular buoyant hull assemblies according to this invention.

The present invention consists of several concepts to improve the reliability and performance of buoyant hull assemblies used to support large floating structures. Referring to the drawings, wherein the same reference numerals and symbols are used throughout to designate like parts, FIG. 1 illustrates schematically in elevational view the general configuration of a floating structure 10 according to this invention. Typically, because of its very large size the structure 10 comprises multiple modules 12 incorporating the features of the invention. Therefore, the preferred embodiment is described throughout in terms of multiple modules combined utilizing technology disclosed in my referenced patents, but it is understood that the features of the invention are equally applicable to each module and that all of them can be implemented advantageously also with a structure consisting of a single module.

The floating structure 10 is shown simply as comprising decks 14 joined at boundaries 16 and supported by buoyant hull assemblies 18. In practice, though, much additional structure would exist, such as other decks and various facilities to which the floating platform would be dedicated. These additional features are not described here because they are not part of or necessary to the disclosed invention.

As illustrated in FIG. 1, each hull assembly 18 consists of buoyant hulls 20 partially submerged under the surface L of the body of water supporting the floating structure and provides buoyancy to the module 12 to which it is attached. The hulls 20 are attached in pairs to a walking beam 22 having an A-frame type of structure, which is pivotally connected to the deck 14 by means of a flexible joint or fulcrum 24 and a shock-absorbing hydraulic cylinder 26. The cylinder of each module is hydraulicly coupled to all other cylinders through a piping system 28 that permits the hydraulic fluid to flow from any cylinder 26 under compression to another cylinder under expansion. A spring or other resilient means 30 urges each cylinder 26 toward expansion, so as to provide resilient resistance to the forces exerted on the cylinders under loaded conditions. The presence and forced flow of the hydraulic fluid provides shock absorption and, if desired, energy that is produced in turbines 32 or equivalent energy-generating apparatus.

Figure 3:
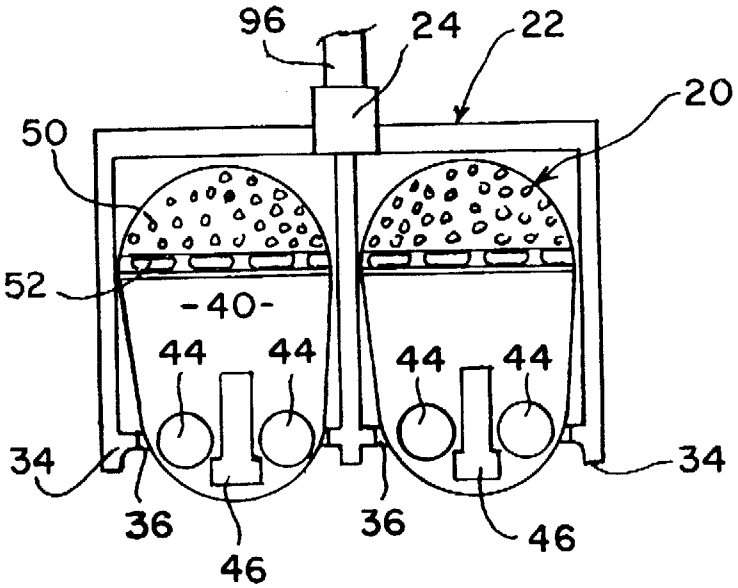
FIG. 3 is a schematic side view of the walking beam seen in FIG. 2, showing one of each pair of hulls anchored to the beam.
Figure 2:
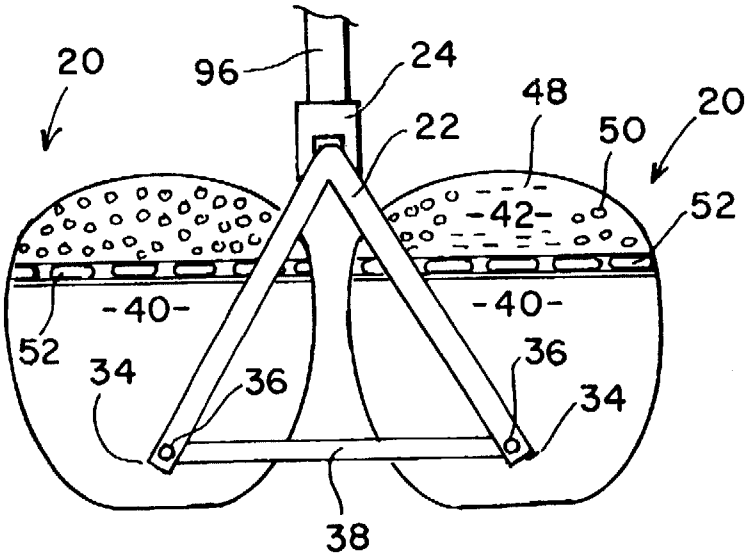
FIG. 2 is a schematic elevational view of an A-frame walking beam according to the invention showing one of two pair of buoyant hulls pivotally anchored to the beam along an axis below the center of gravity of each hull.

The A-frame configuration of the walking beam 22 according to the invention is suitable for anchoring the buoyant hulls 20 at a point below the center of gravity of the hull, so that the point of application of the upward force resulting from its buoyancy is always above the anchor axis. Thus, the hulls 20 are always forced upward by the water in which they are partly submerged, in stable position with respect to the walking beam 22 supported by them. As shown schematically in FIGS. 2 and 3, two parallel pairs of hulls 20 are preferably connected to each walking beam 22 in symmetric configuration with respect to the flexible joint 24 that connects the beam 22 to the upper portion of the hull assembly 18. Each hull 20 is pivotally anchored to an end 34 of the walking beam by means of an axle 36 around which the hull is free to rotate. Thus, in response to the motion of the waves striking them, the hulls 20 can swing from side to side, thereby minimizing resistance to the water and providing relative stability to the joint 24 and the floating platform 10. A reinforcing support truss 38 may be used to tie each pair of ends 34 in the walking beam 22.

Each hull 20 includes a lower sealed, buoyant section 40 and an upper perforated, non-buoyant section 42. The lower section 40 may contain propellers 44 or equivalent means of propulsion, so that each module is independently mobile. The lower section 40 may also comprise a sump pump 46 or other device for controlling a water level in the sealed interior of the section in order to vary the buoyancy of the hull and, correspondingly, the degree of submersion of the assembly 18. The upper section 42 of the hull is defined by a skin 48 with uniform perforations 50 scattered throughout its surface in order to further reduce the impact of the force exerted by the waves striking the hulls 20. The water splashing on top of the hull is scattered and trapped by the perforations 50 to flow inside the section 42, and the energy of the waves is thus dissipated with minimal impact on the rest of the structure. Scuppers 52 are provided around the bottom of the section 42 for drainage when the section is above water level.

Figure 4:
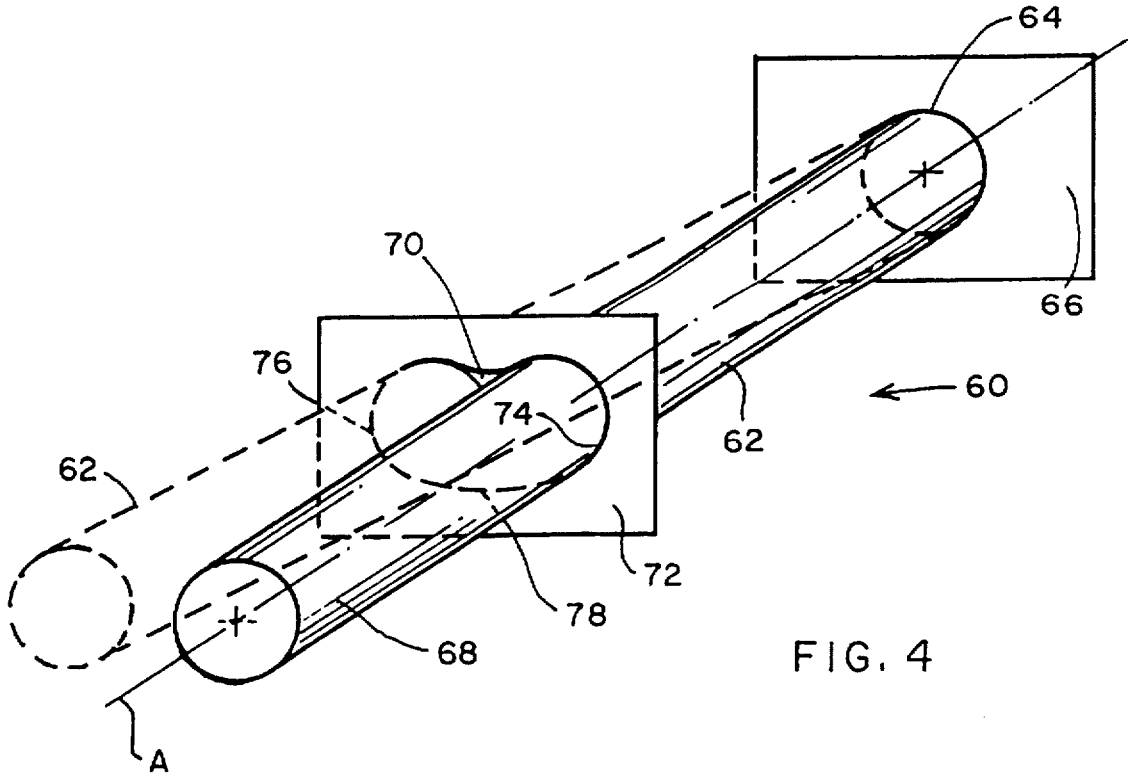
FIG. 4 is a simplified perspective view of the universal joint of the invention illustrating the lateral movement of the shaft pivotally braced between an anchor plate and a support plate.

The walking beam 22 of each hull assembly 18 is connected to the deck 14 above by means of a flexible joint 24 that further reduces the effects of the waves passing through. The joint 24 comprises a universal joint designed to accommodate the various motions of the floating platform while remaining in stable equilibrium as a result of the gravitational forces acting on it. As illustrated schematically in FIG. 4, a universal joint 60 according to the invention embodies a transverse shaft 62 with one side 64 anchored in swivel arrangement to an anchor block 66; and the other side 68 of the shaft is passed through and supported by a curved, oblong opening 70 (banana-shaped) in a support block 72. The opening 70 is wider than the diameter of the shaft 62, so that the shaft is free to pivot within the anchor block 66 and swing from side to side substantially along the main cross-sectional axis of the opening 70, the degree of freedom of the shaft depending on the dimensions of that opening. Obviously, as illustrated in phantom line in FIG. 4, the shaft 62 can move from one end 74 of the opening 70 to the other end 76 in response to lateral forces. The opening 70 is curved so as to define a low point or vertex 78 where the shaft 62 rests in stable equilibrium under gravity. Finally, the shaft 62 is fitted with a locking pin 80 (seen in FIG. 6) or equivalent apparatus to limit its rotation around the shaft's longitudinal axis A while permitting its pivotal motion within the opening 70. Thus, the shaft/anchor/support constituting the universal joint 60 provides a means to connect a load to a supporting structure allowing for relative lateral motion between the two that absorb lateral forces exerted on either, and provides a built-in mechanism for achieving a predetermined relative position of rest when such forces cease.

Figure 5:
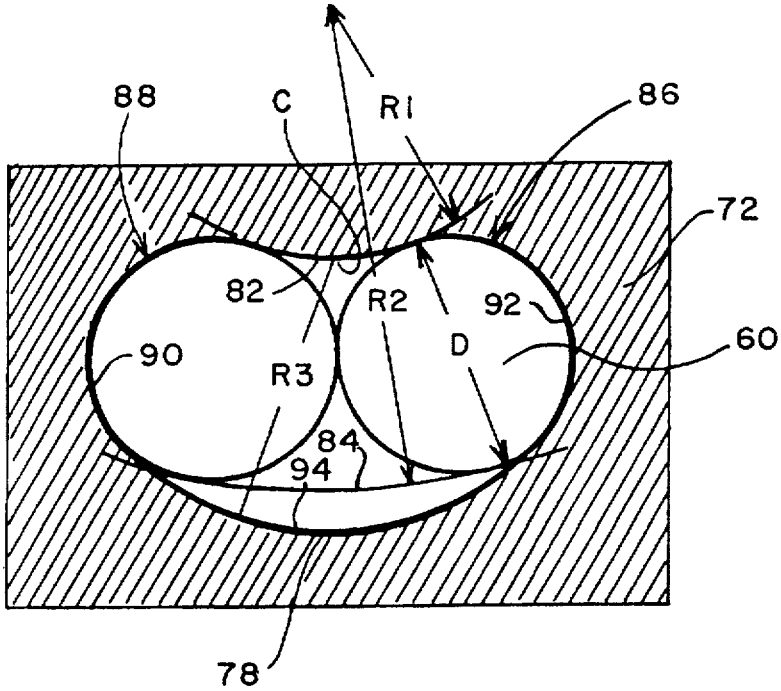
FIG. 5 is an illustration of the cross-sectional geometry of the preferred embodiment of the opening in the support block of the invention.

FIG. 5 illustrates the cross-sectional geometry of the preferred embodiment of the opening 70. The opening is defined by two arcs, 82 and 84, of concentrical circles having radii R1 and R2, respectively, wherein the difference D between R2 and R1 is at least equal to the diameter of the shaft 62, preferably slightly greater, so that the shaft can loosely fit within it. The arcs 82 and 84 define an annulus portion within which two symmetrical circles with diameter D, 86 and 88, are outlined to define the lateral boundaries 90 and 92 of the opening 70. Note that the circles 86 and 88 are shown adjacent to one another in FIG. 5, but any symmetrical position, overlapping or at some distance from one another, would simply be a matter of choice to provide the required degree of lateral motion for the shaft 62. Finally, a low point or vertex 78 is established by connecting the lateral boundaries 90 and 92 of the circles 86 and 88 with an arc 94 defined by a circle with its center C at the midpoint of the arc 82 and a radius R3 equal to the distance between C and the farthest point on either of the two circles 86 and 88.

Figure 6:
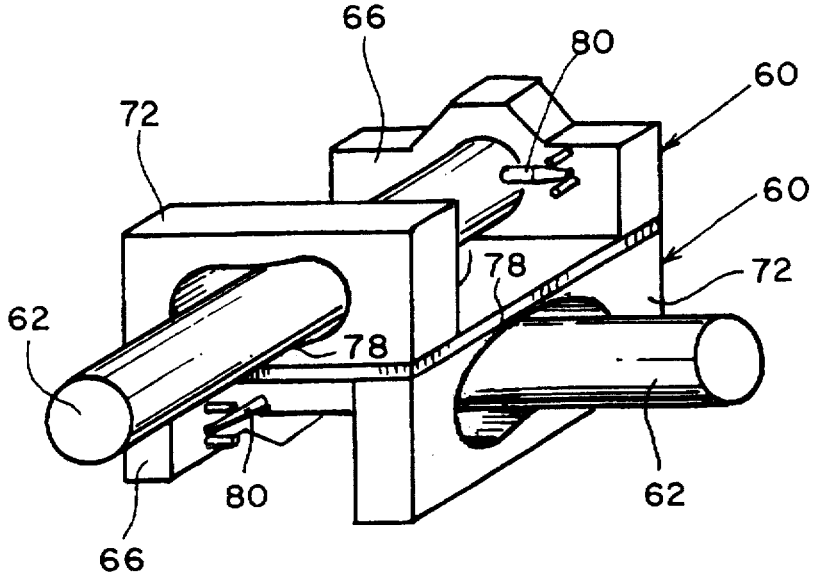
FIG. 6 is a perspective view of a flexible joint that consists of two universal joints according to the invention connected at right angle and one upside down with respect to the other.

FIG. 6 is a perspective view of a flexible joint 24 that consists of two universal joints 60 according to the invention connected at right angle and one upside down with respect to the other. The two universal joints are rigidly coupled at their anchor and support blocks 66 and 72, while each shaft 62 is rigidly attached to the parts being joined. As used in the hull assembly of the invention, the shaft of the top universal joint is attached to the ram 96 and the shaft of the bottom universal joint is attached to the walking beam 22 (see FIGS. 1–3). This combination provides freedom for limited movement in all directions and in a stable arrangement under load. As waves pass through and cause the walking beams to adjust for variations in the water level, gravity urges the shafts 62 to seek the vertex 78 in their respective support blocks 72 and the swivel motion of the shafts against gravity provides shock absorptions to reduce the effect of the waves on the floating deck 14 above. Note that the term vertex, as used in this disclosure, refers to both the high and low point 78 in the opening 70 of the block 72, depending on whether the block is curved upward or downward.

Figure 7:
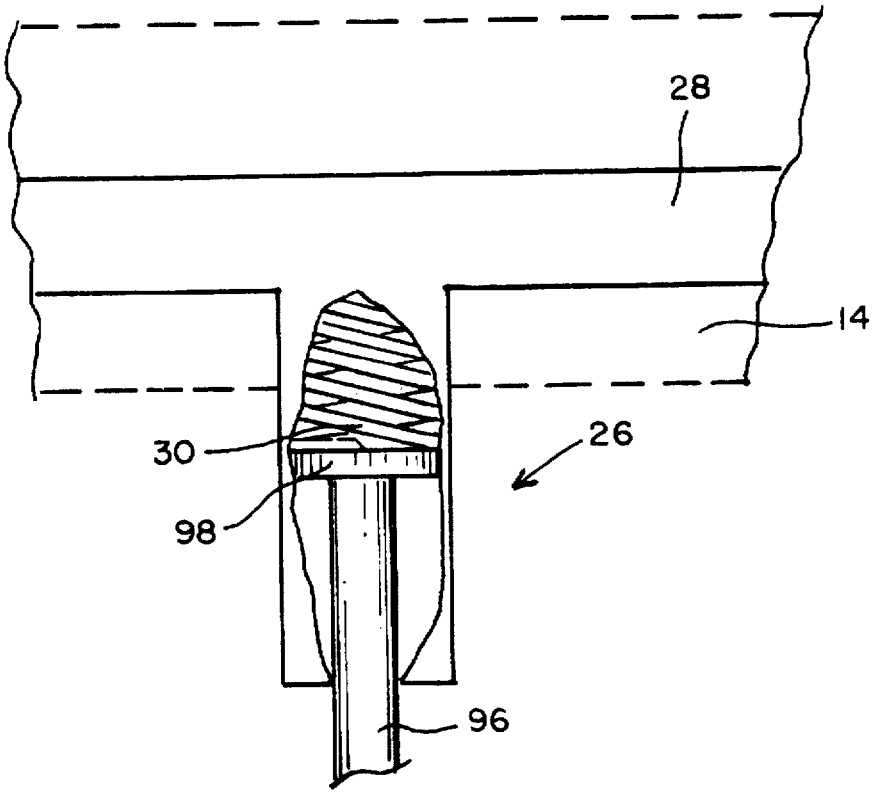
FIG. 7 is a partially cut-out view of a hydraulic cylinder used in the shock-absorption and energy-generation system of the invention.

In order to further buffer the floating structure 10 from forces acting on the hull assemblies 18, each assembly is coupled to the corresponding deck 14 by means of a shock-absorbing, hydraulic cylinder 26. As illustrated in FIG. 7, the cylinder 26 includes a conventional ram 96 with a plunger 98 urged downward by a spring 30 sufficiently strong to support the weight of the deck 14 when partly compressed, so as to allow for a resilient response and further compression when an upward force is exerted by the hull assembly 18. The pressure side of the cylinder 26 is filled with hydraulic fluid and is connected to the cylinders 26 of other modules through a piping system 28, such that any compression or expansion of the plunger 98 in one cylinder produces a corresponding expansion or compression in one or more other cylinders, as determined by the balance of upward forces acting on the various modules. The forced flow of the hydraulic fluid provides shock absorption and fluid flow that can be exploited for generating energy. Turbines 32 (FIG. 1) or equivalent energy-generating apparatus can be utilized to convert the pressure of the flowing fluid into usable energy. Thus, much of the energy delivered by the water waves that would otherwise heave the floating structure 10 can be converted and stored for use onboard.

Various modifications are possible within the meaning and range of equivalence of the appended claims. Therefore, while the present invention has been shown and described herein in what is believed to be the most practical and preferred embodiments, it is recognized that departures can be made therefrom within the scope of the invention, which is not to be limited to the details disclosed herein, but is to be accorded the full scope of the claims so as to embrace any and all equivalent apparatus and methods.

I claim:

1. A buoyant hull assembly for a floating structure comprising:

a walking beam; and a pair of buoyant hulls, each hull being pivotally connected to the beam through a pivot axis such that a center of gravity of the hull is located above said pivot axis when the hull is floating.

2. The buoyant hull assembly of claim 1, wherein said walking beam has two ends disposed in A-frame arrangement and a midsection pivotally mounted on a fulcrum between the walking beam and a deck.

3. The buoyant hull assembly of claim 1, wherein each of said hulls comprises a lower buoyant section and an upper non-buoyant section.

4. The buoyant hull assembly of claim 3, wherein said lower buoyant section comprises means for propelling the hull.

5. The buoyant hull assembly of claim 3, wherein said lower buoyant section comprises means for controlling a water level in said section in order to vary the buoyancy of the hull and, correspondingly, the degree of submersion of the hull assembly.

6. The buoyant hull assembly of claim 3, wherein said upper non-buoyant section comprises a skin with perforations to trap splashing water and comprises scuppers for water drainage when said section is above water level.

7. The buoyant hull assembly of claim 2, wherein said fulcrum comprises a transverse shaft having one end connected in swivel arrangement to an anchor block and being supported by a curved oblong opening in a support block, such that the shaft rests in stable equilibrium at a vertex of the curved oblong opening under gravitational forces when free from lateral forces, wherein the walking beam is coupled to one of the walking beam or the deck and the support block is coupled to the other.

8. The buoyant hull assembly of claim 1, further comprising shock-absorbing means for dampening forces acting between said walking beam and a deck.

9. The buoyant hull assembly of claim 8, wherein said shock-absorbing means comprises a hydraulic cylinder.

10. The buoyant hull assembly of claim 9, further comprising resilient means for urging said hydraulic cylinder toward expansion, so as to provide resilient resistance to forces exerted on the cylinder under loaded conditions.

11. The buoyant hull assembly of claim 9, wherein said hydraulic cylinder is fluidly connected to another hydraulic cylinder providing dampening to another walking beam of the floating structure, such that hydraulic fluid flows between said cylinders under compression or expansion of either cylinder.

12. The buoyant hull assembly of claim 11, further comprising energy-generation means for converting a fluid flow between said cylinders into usable energy.

13. The buoyant hull assembly of claim 7, further comprising shock-absorbing means for dampening forces acting between said walking beam and deck.

14. The buoyant hull assembly of claim 13, wherein said shock-absorbing means comprises a hydraulic cylinder fluidly connected to another hydraulic cylinder providing dampening to another walking beam of the floating structure, such that hydraulic fluid flows between said cylinders under compression or expansion of either cylinder.

15. The buoyant hull assembly of claim 14, further comprising energy-generation means for converting a fluid flow between said cylinders into usable energy.

16. The buoyant hull assembly of claim 14, further comprising resilient means for urging said hydraulic cylinders toward expansion, so as to provide resilient resistance to forces exerted on the cylinders under loaded conditions.

17. A buoyant hull assembly for a floating structure comprising a universal joint between a walking beam and a deck, said universal joint comprising a transverse shaft having one end connected in swivel arrangement to an anchor block and being supported by a curved oblong opening in a support block, such that the shaft rests in stable equilibrium at a vertex of the curved oblong opening under gravitational forces when free from lateral forces, wherein the walking beam is coupled to one of the walking beam or the deck and the support block is coupled to the other.

18. A buoyant hull assembly for a floating structure comprising shock-absorbing means for dampening forces acting between a walking beam and a deck, wherein said shock-absorbing means comprises a hydraulic cylinder fluidly connected to another hydraulic cylinder providing dampening to another walking beam of the floating structure, such that hydraulic fluid flows between said cylinders under compression or expansion of either cylinder.

19. The buoyant hull assembly of claim 18, further comprising energy-generation means for converting a fluid flow between said cylinders into usable energy.

20. The buoyant hull assembly of claim 18, further comprising resilient means for urging said hydraulic cylinders toward expansion, so as to provide resilient resistance to forces exerted on the cylinders under loaded conditions.

* * * * *